US007007426B1

(12) United States Patent
Ohlman, III et al.

(10) Patent No.: US 7,007,426 B1
(45) Date of Patent: Mar. 7, 2006

(54) FLORAL PRODUCT CONTAINER AND METHOD OF MAKING THE SAME

(75) Inventors: Lawrence J. Ohlman, III, Toledo, OH (US); Lawrence J. Ohlman, Jr., Toledo, OH (US); William H. Bettinger, Toledo, OH (US)

(73) Assignee: Ohlman Farm and Greenhouse, Toledo, OH (US)

( * ) Notice: Subject to any disclaimer, the term of this patent is extended or adjusted under 35 U.S.C. 154(b) by 0 days.

(21) Appl. No.: 10/916,939

(22) Filed: Aug. 12, 2004

Related U.S. Application Data

(60) Provisional application No. 60/494,611, filed on Aug. 12, 2003.

(51) Int. Cl.
*A01G 9/02* (2006.01)

(52) U.S. Cl. ..... 47/84

(58) Field of Classification Search ..... D9/418, D9/431; 47/65.5, 65.6, 67, 68, 72, 75, 81, 47/84; 206/423, 514; 222/4.26–4.27; 229/113, 229/114, 148, 149, 150, 151, 162, 185; 414/788.2
See application file for complete search history.

(56) References Cited

U.S. PATENT DOCUMENTS

| | | | | |
|---|---|---|---|---|
| 1,994,400 | A * | 3/1935 | Mulford | 47/84 |
| 2,340,373 | A * | 2/1944 | Gardner | 47/84 |
| 2,474,543 | A * | 6/1949 | McLellan | 206/423 |
| 3,021,046 | A * | 2/1962 | Pullen | 47/84 |
| 3,552,059 | A | 1/1971 | Moore | |
| 3,734,275 | A * | 5/1973 | Greene, III | 206/45.25 |
| 3,966,043 | A * | 6/1976 | Devroe | 206/423 |
| 4,071,064 | A | 1/1978 | Saul | |
| 4,075,786 | A | 2/1978 | van Zyl | |
| 4,118,890 | A | 10/1978 | Shore | |
| 4,242,835 | A | 1/1981 | Mondragon Sorribes | |
| 4,662,107 | A | 5/1987 | Van Den Kieboom | |
| 4,863,015 | A | 9/1989 | Toltzman | |
| 4,915,224 | A | 4/1990 | Wulf et al. | |
| 4,936,046 | A | 6/1990 | Miller | |
| 4,941,572 | A | 7/1990 | Harris | |
| D315,049 | S | 3/1991 | Alpers et al. | |
| D315,095 | S | 3/1991 | Wright | |
| 5,001,860 | A | 3/1991 | Rudnick | |
| 5,029,708 | A | 7/1991 | Alonso et al. | |
| 5,106,662 | A * | 4/1992 | Khayat | 428/23 |
| 5,121,779 | A * | 6/1992 | Green | 141/337 |
| D332,746 | S | 1/1993 | Garcia | |
| 5,224,598 | A | 7/1993 | Angeles et al. | |
| 5,379,549 | A | 1/1995 | Carcich et al. | |
| D357,627 | S | 4/1995 | Angeles et al. | |
| 5,454,213 | A | 10/1995 | Gola | |
| D429,638 | S | 8/2000 | Li et al. | |
| D434,648 | S | 12/2000 | Li et al. | |
| 6,463,697 | B1 | 10/2002 | Weder et al. | |
| 6,523,740 | B1 | 2/2003 | Campbell | |
| 6,595,363 | B1 | 7/2003 | Peters | |

* cited by examiner

*Primary Examiner*—Francis T. Palo
(74) *Attorney, Agent, or Firm*—Marshall & Melhorn, LLC

(57) ABSTRACT

A floral product container and method of making the same is disclosed. The floral product container has a back and two sides that define an open top. A front portion of the floral product container is partially, selectively closeable with flaps connected to the two side panels.

15 Claims, 4 Drawing Sheets

FLORAL PRODUCT CONTAINER AND METHOD OF MAKING THE SAME

RELATED APPLICATION

This application is claiming the benefit, under 35 U.S.C. § 119(e), of the provisional application filed on Aug. 12, 2003, under 35 U.S.C. § 111(b), which was granted Ser. No. 60/494,611, and is hereby incorporated by reference in its entirety.

FIELD OF THE INVENTION

The present invention relates to containers for floral products and a method for making the same.

BACKGROUND OF THE INVENTION

Containers for shipping plants and the like are well known. For example, U.S. Pat. No. 6,595,363 teaches a floral shipper having an outer container with a rectangular base and four sidewalls extending upwardly from the base. A top wall is created by two flaps connected to two of the four sidewalls. An inner container is also provided that has a periphery which closely conforms to the sidewalls of the outer container. Ventilation openings are provided in the inner and outer containers for the plants therein.

U.S. Pat. No. 6,523,740 provides for a tapered floral container having a pair of forward walls, a pair of rearward walls and a bottom wall. At least one of the forward walls is taught to have a transparent portion adjacent the upper end of the container. The transparent portion functions as a window to an interior portion of the container and the plants therein.

U.S. Pat. No. 5,029,708 provides for a potted plant shipping and display carton. The carton has top flaps that are perforated for the removal of arcuate portions in the flaps and which form a circular rim defining an aperture through which a flower pot is placed for support. Pop-in segments are formed across the corners of adjacent side panels by parallel lateral slits and parallel vertical hinges. The segments enable the carton to be reversed to support the weight of the flower pot by the top flaps. The top flaps are infolded to suspend the flower pot below the top end of the carton to hide the pot but display the flowers or plant.

Additionally, U.S. Pat. No. 4,118,890 teaches a plant package designed to protect and maintain plants during shipment, storage and display. The package is constructed of a light-transmitting outer plastic material having a polygonal cross section. Side panels of the package are connected to front and back panels by upright supporting seams. The patent states that the container is hermetically sealed and preferably inflated. A flexible, closed bag in the base of the container holds the plant roots and soil.

In light of the above described prior art, it would be advantageous to have a floral product container that can be used for shipping, storing and displaying plants located therein. It would also be advantageous for the container to have means to secure delicate plant stems to the package to prevent damage during shipping. It would also be advantageous for the container to accept pots of varying height and have means to selectively secure those pots within the container.

SUMMARY OF THE INVENTION

The present invention is directed toward a floral product container having a back panel, two side panels and a container receptacle. The container receptacle is integrally formed with the back panel. The back panel and the two side panels define an open top for the floral product container. A front portion of the floral product container is partially, selectively closeable with flaps connected to the two side panels.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
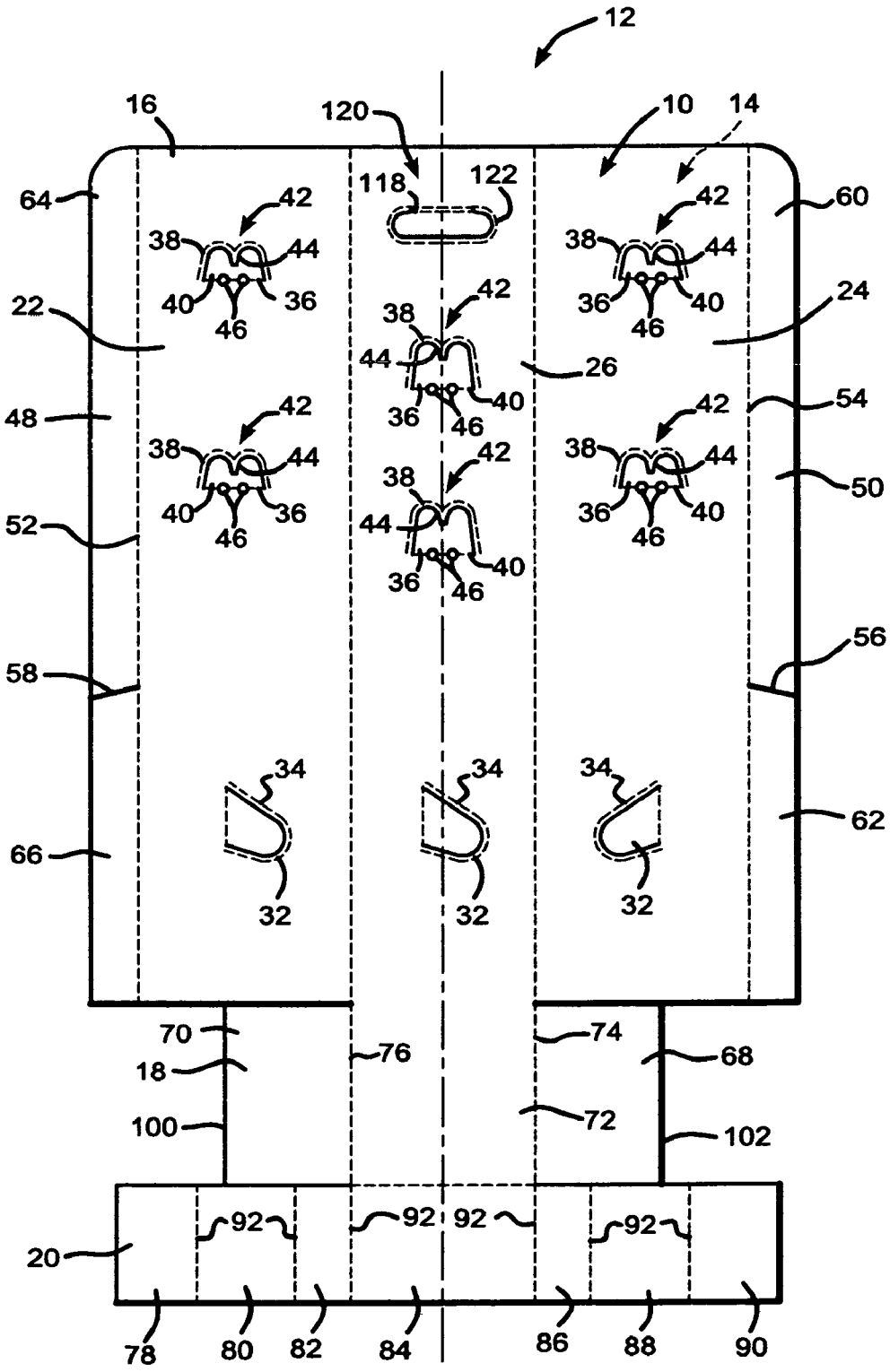
FIG. 1 is a front view of a preferred embodiment of the invention in an unassembled state.

FIG. 1 depicts a first side 10 of a disassembled floral product container 12 of a preferred embodiment of the present invention. The first side 10 can be decorated with designs, colors and/or words. Similarly, a second side 14 of the container 12, opposite the first side 10, can also be decorated with designs, colors and/or words. The decorations make the container 12 appealing to customers and allow the container 12 to be used as a display to complement and advertise the product located therein.

The container 12 has a first sheet of material 16 connected to a second sheet of material 18. The second sheet of material 18 is connected to a third sheet of material 20. The three sheets of material 16, 18, 20 may be separate sheets that have been joined together or they may be cut from a single sheet. In the embodiment where the three sheets of material 16, 18, 20 are cut from a single sheet, they may be joined by non-perforated fold lines or by perforated lines.

The sheets of material 16, 18, 20 are preferably constructed of pre-cut corrugated cardboard coated with a sealant, such as wax or an equivalent material, to protect it from moisture. Other materials such as wood, plastic, glass, metal, and/or composite materials may be used without departing from the scope of the present invention.

Figure 2:
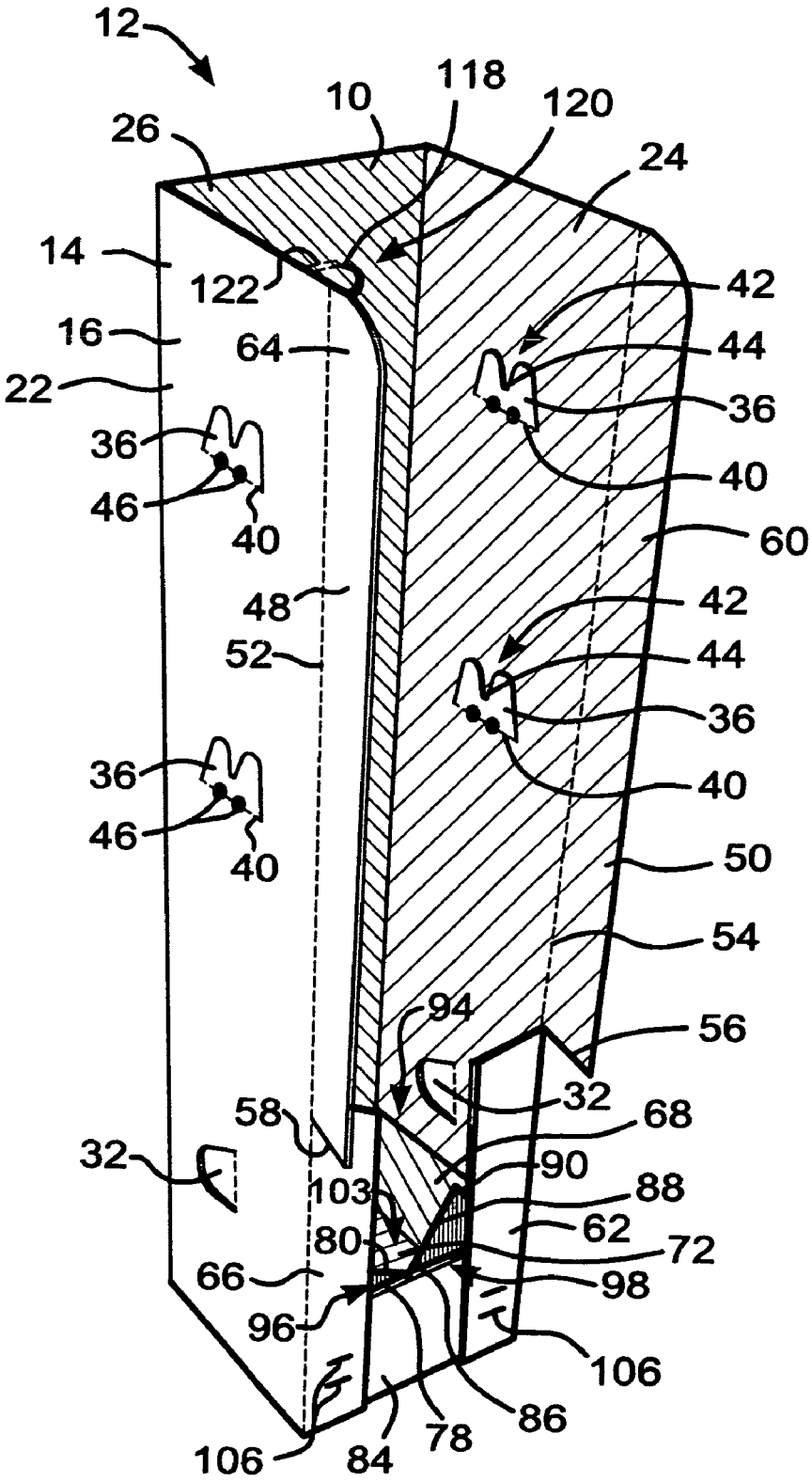
FIG. 2 is a perspective view of a preferred embodiment of the present invention.
Figure 4:
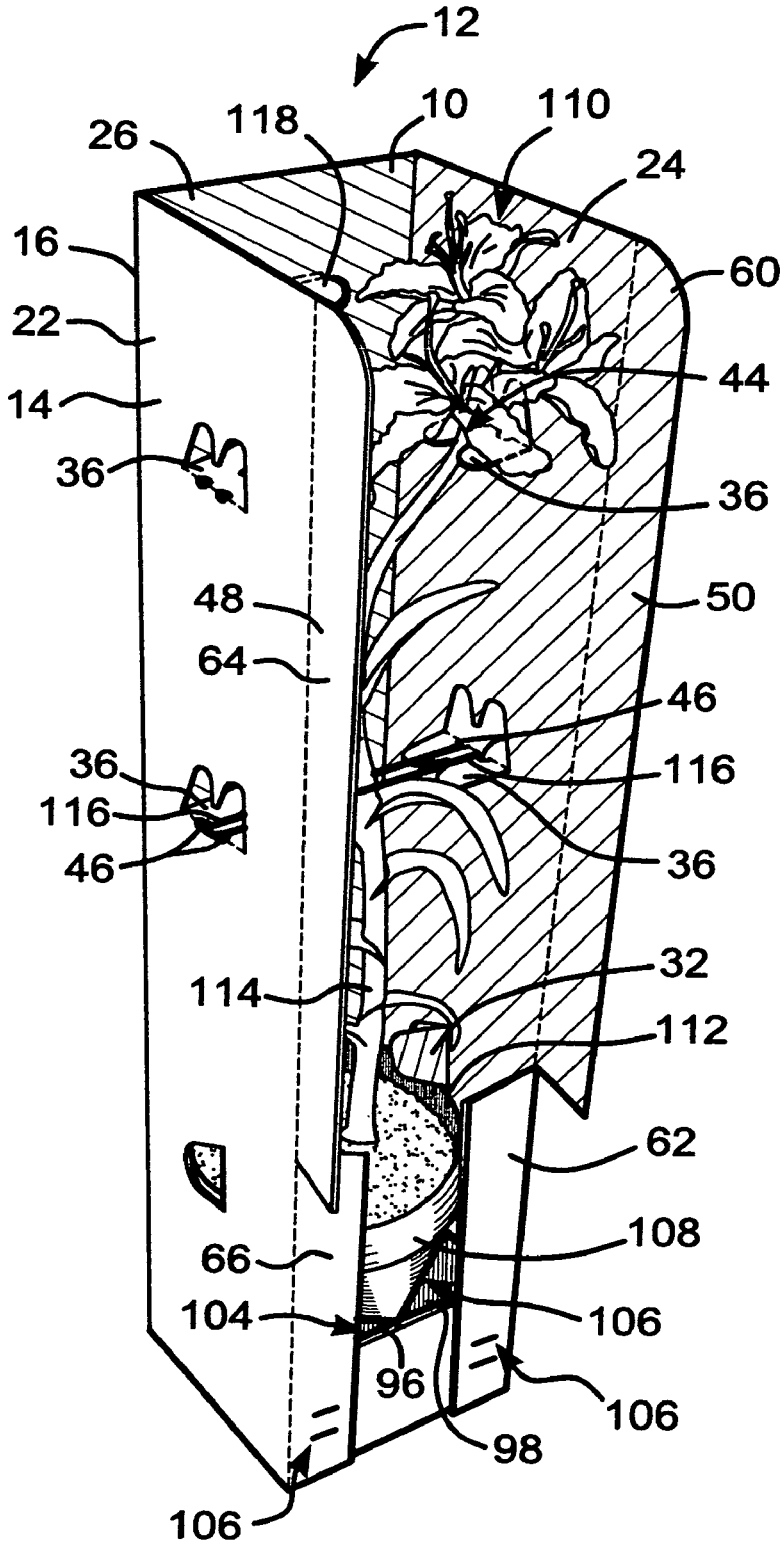
FIG. 4 is a perspective view of a preferred embodiment of the present invention.

The first sheet of material 16 preferably has a first side panel 22, a second side panel 24 and a back panel 26. The first side panel 22 is connected to the back panel 26 with at least one perforation line, designated a first perforation line 28, and the second side panel 24 is connected to the back panel 26 with at least one perforation line, designated a second perforation line 30. Those skilled in the art will appreciate that other connection means, such as non-perforated fold lines, may be used without departing from the scope of the present invention. Regardless of the connection means used, it is preferred that the means allows the first side panel 22 to be folded ninety degrees toward the back panel 26 and the second side panel 24 to be independently folded ninety degrees toward the back panel 26, as best seen in FIGS. 2 and 4.

Referring back to FIG. 1, at least one tab 32 is preferably located within each of the side panels 22, 24 and the back panel 26. A greater number of tabs 32 may be located in each or all of the panels 22, 24, 26, or a fewer number tabs 32 may be located in each or all of the panels 22, 24, 26. In the preferred embodiment, each tab 32 is angled downwardly toward the second sheet of material 18.

Each tab 32 is defined by a plurality of perforations 34 that outline the tab 32 in the panels 22, 24, 26. The perforations 34 allow each tab 32 to be separated from its panel 22, 24, 26, and selectively moved inwardly, as described in more detail below.

In the preferred embodiment, each panel 22, 24, 26 also has at least two hinged supports 36. A greater number of hinged supports 36 may be located in each or all of the panels 22, 24, 26, or a fewer number of hinged supports 36 may be located in each or all of the panels 22, 24, 26. Each hinged support 36 is defined by a plurality of perforations 38 that outline the hinged support 36 in the panel 22, 24, 26. The perforations 38 allow each hinged support 36 to be separated from its panel 22, 24, 26, and selectively moved inwardly, as described in more detail below.

In the preferred embodiment, each hinged support 36 is M-shaped, although other shapes are well within the scope of the present invention. A base 40 of the hinged support 36 is hingedly connected to its respective panel 22, 24, 26. At least one plant stem receiving portion 42 is integrally formed with each hinged support 36. Preferably, the plant stem receiving portion 42 is a groove 44 located in the hinged support 36. The groove 44 gradually converges to a point at a predetermined location in the hinged support 36. The gradual convergence of the groove 44 allows plants stems of a variety of sizes to be located in the groove 44.

Preferably, at least two apertures 46 are located at the base 40 of each hinged support 36. The apertures 46 preferably extend through their respective panel 22, 24, 26. Based on the additional description of the present invention below, those skilled in the art will appreciate that the apertures 46 can be located anywhere on any of the panels 22, 24, 26 and in any number.

In the preferred embodiment, the first and second side panels 22, 24 are both fitted with flaps. For the purposes of clarity and reference to the figures, the flap attached to the first side panel 22 will be designated the left flap 48 and the flap attached to the second side panel 24 will be designated the right flap 50. The left and right flaps 48, 50 preferably run the length of the first and second side panels 22, 24, respectively. The left flap 48 is defined by, and selectively moveable by, a plurality of perforations 52 in the first side panel 22. The right flap 50 is defined by, and selectively moveable by, a plurality of perforations 54 in the second side panel 24. Alternatively, the left flap 48 and the right flap 50 may be defined by non-perforated fold lines.

A split 56 is located in the right flap 50 and a split 58 is located in the left flap 48. The splits 56, 58 may be angled up or down across the flaps 48, 50, or the splits 56, 58 may be straight across the flaps 48, 50. The splits 56, 58 define the right flap 50 into an upper portion 60 and a lower portion 62 and the left flap 48 into an upper portion 64 and a lower portion 66. As discussed in more detail below, the splits 56, 58 allow the upper portions 60, 64 of the right and left flaps 48, 50 to be moved independently of the lower portions 62, 66 of the right and left flaps 48, 50.

The second sheet of material 18 preferably has a right panel 68, a left panel 70 and a center panel 72. In the preferred embodiment, the right panel 68 is connected to the center panel 72 by a plurality of perforations and the left panel 70 is connected to the center panel 72 by a plurality of perforations. More specifically, the right panel 68 is preferably connected to the center panel 72 with a right perforation line 74 and the left panel 70 is preferably connected to the center panel 72 with a left perforation line 76. In the preferred embodiment, the right perforation line 74 and the left perforation line 76 are aligned with the first perforation line 28 and the second perforation line 30, respectively. Those skilled in the art will appreciate that the right perforation line 74 and the left perforation line 76 may also be non-perforated fold lines. Regardless of the connection means used, it is preferred that the means allows the right panel 68 to be folded toward the center panel 72 and the left panel 70 to be folded toward the center panel 72, as described below.

The third sheet 20 has a first sub-panel 78, a second sub-panel 80 and a third sub-panel 82 on the left side of a center panel 84 and a first sub-panel 86, a second sub-panel 88 and a third sub-panel 90 on the right side of the center panel 84. Preferably, each sub-panel 78–82, 86–90 is defined by a separate perforation line 92, or fold line.

Figure 3:
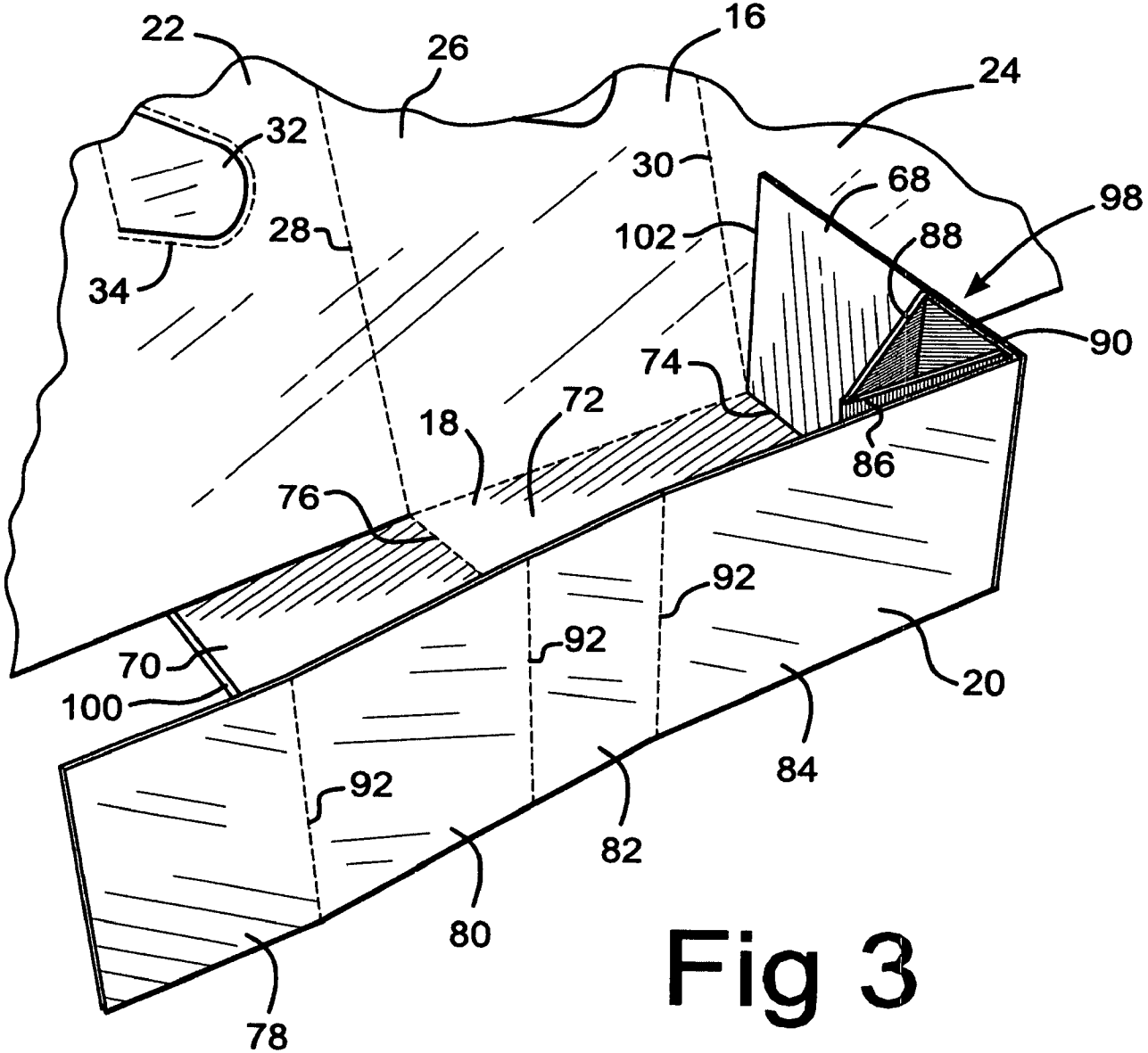
FIG. 3 is a partial, perspective view of the present invention during assembly.

A method of making the floral product container 12 includes providing the first sheet of material 16 connected to the second sheet of material 18 and the second sheet of material 18 connected to the third sheet of material 20, as shown in FIG. 1. A container receptacle 94, depicted in FIG. 2, is formed by folding both the first sub-panel 78, the second sub-panel 80 and the third sub-panel 82 on the left hand side into a triangle 96 and the first sub-panel 86, the second sub-panel 88 and the third sub-panel 90 on the right hand side into a triangle 98, as shown in FIGS. 2 and 3. Each triangle 96, 98 is rotated ninety degrees into contact with the center panel 84. More specifically, the first sub-panel 86 on the right side is located adjacent the center panel 84 and the first sub-panel 78 on the left side is located adjacent the center panel 84 so that the perforation line 92 between the first sub-panel 86 and the second sub-panel 88 on the right side is located adjacent the perforation line 92 between the first sub-panel 78 and the second sub-panel 80 on the left side.

Folded in this arrangement, the sub-panels 78–82, 86–90 and the center panel 84 of the third sheet 20 are rotated ninety degrees until the base of each sub-panel 78–82, 86–90 on the right and left sides contacts the center panel 84 of the second sheet 18. The right panel 68 of the second sheet 18 is folded inward ninety degrees until it contacts the third sub-panel 90 of the right side of the third sheet 20. The left panel 70 of the second sheet 18 is folded inward ninety degrees until it contacts the third sub-panel 82 of the left side of the third sheet 20.

The entire structure is rotated ninety degrees toward the back panel 26 of the first sheet 16. The edge 100 of the left panel 70 of the second sheet 18 and the edge 102 of the right panel 68 of the second sheet 18 contact the back panel 26 to form the container receptacle 94.

The second sub-panels 80, 88 of the right and left sides of the third sheet 20 form angled walls within the container receptacle 94. The angled walls converge toward a front portion 103 of the container receptacle 94 and act as a container support 104, as seen in FIGS. 2 and 4.

The first and second side panels 22, 24 of the first sheet 16 are rotated ninety degrees toward the container receptacle 94. More specifically, the first and second side panels 22, 24 are rotated until they contact the sides of the container receptacle 94. The lower portion 66 of the left flap 48 and the lower portion 62 of the right flap 50 are then rotated ninety degrees to contact the front of the container receptacle 94. One or more mechanical fasteners 106 are located through the lower portion 66 of the left flap 48 and the lower portion 62 of the right flap 50. The mechanical fasteners 106 extend through the flaps 48, 50, through the center panel 84 of the third sheet 20 and into the first sub-panels 78, 86 of the third sheet 20. Preferably, the mechanical fasteners 106 are staples, however, nails, bolts, clips, clamps and screws are/or within the scope of the present invention. Adhesives and tapes are also well within the scope of the present invention.

A plant container 108, having a plant 110, such as an orchid, is located in the container receptacle 94, as shown in FIG. 4. Those skilled in the art will appreciate that the present invention is not limited to orchids. Instead, any plant may be located within the container 108.

The angled walls 80, 88 of the container receptacle 94 contact the container 108 and help to keep it in place. At least one of the tabs 32 is removed from its perforations 34 in the side panels 22, 24 or the back panel 26 and moved inwardly toward the container 108. Preferably, the tab 32 is placed in contact with the top edge 112 of the container 108. By locating the tab 32 at an angle, a variety of containers 108 having differing heights can be located in the container receptacle 94 and secured by the tab 32.

Preferably, at least one of the hinged supports 36 is removed from its perforations 38 in the side panels 22, 24 or the back panel 26 and moved inwardly toward a plant stem 114. The plant stem 114 is manually located within the groove 44. Securing means 116, such as a tie, string, wire or a cord, are located through one of the apertures 46, around the plant stem 114, and then back through the other aperture 46. The securing means 116 are then tied or otherwise secured outside of the container 12. The hinged support 36 and the securing means prevents, or reduces, undesirable movement of the plant stem 114.

The hinged support 36, or hinged supports, with a plant stem 114 secured thereto, allows air to enter into the container 12. Those skilled in the art will appreciate that hinged supports 36 that do not have a stem 114 secured thereto may also be used for ventilation, in addition to the apertures 46.

The upper portion 60 of the right flap 50 can be rotated ninety degrees in an inward or an outward direction. The upper portion 64 of the left flap 48 can also be rotated ninety degrees in an inward or an outward direction. Rotation of the upper portions 60, 64 inwardly acts to protect a plant 110 located within the container 12. Rotation of the upper portions 60, 64 outwardly acts to open up the container 12 to provide a better view of the plant 110 within the container 12 for display.

An oval shaped handle 118 is preferably located in an upper portion 120 of the back panel 120. The handle 118 is defined at least in part by a plurality of perforations 122 that allow the handle 118 to be selectively removed the back panel 120. A person can easily grasp the handle 118 to move the container 12 as desired.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed is:

1. A floral product container, comprising:

a back panel, two side panels, and a container receptacle, said container receptacle integrally formed with said back panel, and said two side panels and said back panel defining an open top; and a front portion being partially, selectively closeable with flaps connected to said two side panels.

2. The container of claim 1, wherein each of said side panels and said back panel have integrally formed tabs adjacent said container receptacle.

3. The container of claim 2, wherein said tabs are flexibly connected to said side panels and said back panel.

4. The container of claim 3, wherein said tabs are angled downwardly toward said base portion.

5. The container of claim 4, wherein at least two sub-panels, angled with respect to said side panels, and at least said back panel form said container receptacle.

6. The container of claim 5, wherein said tabs selectively engage a container within said container receptacle to removeably secure said container therein.

7. The container of claim 1, wherein a plurality of hinged supports are located in said two side panels and said back panel.

8. The container of claim 7, wherein said hinged supports are defined by perforations in said side panels and said back panel.

9. The container of claim 8, wherein said hinged supports have a plant stem receiving portion.

10. The container of claim 9, wherein two apertures are located adjacent said hinged supports.

11. The container of claim 1, wherein said back panel has a perforated handle integrally formed therewith.

12. The container of claim 1, wherein said flaps are connected to said side panels with a plurality of perforations.

13. The container of claim 12, wherein a split in each of said flaps to said perforations of said side panels forms an upper flap and a lower flap on one side and an upper flap and a lower flap on said other side.

14. The container of claim 13, wherein each of said upper flaps are selectively moveable about said perforations and each of said lower flaps are secured to said base portion.

15. A floral product container, comprising:

a back panel, two side panels, and a container receptacle, said container receptacle integrally formed with said back panel, and said two side panels and said back panel define an open top;

at least one selectively moveable tab located adjacent said container receptacle;

at least one hinged support said support having a plant stem receiving portion; and a front portion being partially, selectively closeable with flaps connected to said two side panels.

* * * * *